US007974553B2

(12) United States Patent
Matsuo et al.

(10) Patent No.: US 7,974,553 B2
(45) Date of Patent: Jul. 5, 2011

(54) IMAGE FORMING APPARATUS WITH OPENING AND CLOSING ASSEMBLY AND GEARS MOVABLE THEREWITH

(75) Inventors: Yoshihiro Matsuo, Susono (JP); Akira Yuza, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 12/502,605

(22) Filed: Jul. 14, 2009

(65) Prior Publication Data

US 2010/0028044 A1 Feb. 4, 2010

(30) Foreign Application Priority Data

Jul. 30, 2008 (JP) ..... 2008-195701

(51) Int. Cl.
*G03G 15/20* (2006.01)

(52) U.S. Cl. ..... 399/122

(58) Field of Classification Search ..... 399/107, 399/122, 124, 126

See application file for complete search history.

(56) References Cited

U.S. PATENT DOCUMENTS

| | | | | |
|---|---|---|---|---|
| 5,148,226 | A | 9/1992 | Setoriyama et al. | 355/290 |
| 5,210,579 | A | 5/1993 | Setoriyama et al. | 355/285 |
| 5,525,775 | A | 6/1996 | Setoriyama et al. | 219/216 |
| 5,621,451 | A | 4/1997 | Sugiura et al. | 347/112 |
| 5,907,745 | A | 5/1999 | Azuma et al. | 399/92 |
| 5,927,702 | A | 7/1999 | Ishii et al. | 271/9.09 |
| 6,070,867 | A | 6/2000 | Tsurumi et al. | 271/114 |
| 6,244,588 | B1 | 6/2001 | Tsubakimoto et al. | 271/164 |
| 6,308,947 | B1 | 10/2001 | Kojima et al. | 271/124 |
| 6,357,740 | B1 | 3/2002 | Inoue et al. | 271/160 |
| 6,375,183 | B1 | 4/2002 | Inoue et al. | 271/10.11 |
| 6,382,621 | B1 | 5/2002 | Inoue et al. | 271/120 |
| 6,502,816 | B2 | 1/2003 | Inoue et al. | 271/121 |
| 2007/0019977 | A1 * | 1/2007 | Sawamura et al. | |
| 2008/0044203 | A1 * | 2/2008 | Ukai | |
| 2008/0219728 | A1 * | 9/2008 | Lee et al. | |

FOREIGN PATENT DOCUMENTS

| | | |
|---|---|---|
| JP | 4-44075 | 2/1992 |
| JP | 4-44083 | 2/1992 |
| JP | 4-204980 | 7/1992 |
| JP | 4-204984 | 7/1992 |
| JP | 2002-148992 | 5/2002 |
| JP | 2006-47647 | 2/2006 |
| JP | 2007-47298 | 2/2007 |
| JP | 2007033638 A * | 2/2007 |
| JP | 2007-79488 | 3/2007 |
| JP | 2008-164781 | 7/2008 |

* cited by examiner

*Primary Examiner* — David P Porta
*Assistant Examiner* — Milton Gonzalez
(74) *Attorney, Agent, or Firm* — Fitzpatrick, Cella, Harper & Scinto

(57) ABSTRACT

An image forming apparatus has an apparatus main assembly; an image forming unit; a fixing unit which has a pressure applying mechanism and a cam member; an opening and closing member which is attached to the apparatus main assembly to be capable of being opened and closed; a first gear which is provided at the apparatus main assembly; a second gear which is provided at the fixing unit; and a connection gear which connects the first gear and the second gear. The connection gear is configured to be detachable from between the first gear and the second gear and to be attachable being engaged with both the first gear and the second gear only in a case that the first gear and the second gear are respectively at a predetermined phase.

2 Claims, 11 Drawing Sheets

IMAGE FORMING APPARATUS WITH OPENING AND CLOSING ASSEMBLY AND GEARS MOVABLE THEREWITH

BACKGROUND OF THE INVENTION

This application claims the benefit of Japanese Patent Application No. 2008-195701, filed Jul. 30, 2008, which is hereby incorporated by reference herein in its entirety.

FIELD OF THE INVENTION

The present invention relates to an image forming apparatus, such as a copying machine or a printer, which functions to form an image on a recording medium of a sheet.

DESCRIPTION OF THE RELATED ART

Normally, a fixing unit which fixes a toner image transferred onto the sheet by applying heat and pressure is provided in an image forming apparatus which utilizes electrophotography such as a laser-beam printer. The fixing unit is arranged at the downstream side of an image transfer portion of the image forming apparatus and is provided with a pressure roller and a heat unit. Then, the pressure roller and the heat unit are press-contacted to each other so as to form a nip. The toner image is fixed onto the sheet by applying pressure and heat when the sheet passes through the nip.

In order to fix the toner image, considerable pressing force is required. In general, the press-contacting force between the pressure roller and the heat unit is larger than that of other sheet conveying rollers. Therefore, when a sheet jam occurs at the fixing unit, jam recovery may be difficult due to the large pressing force. Thus, there may be problems from fragments of a torn sheet that are difficult to dispose and from the risk of destroying a member since the jam recovery is required to be performed with large force.

Accordingly, mechanisms which interconnect the release of pressing force for fixing with opening of an opening and closing door for performing the jam recovery have been proposed.

For example, a mechanism with which load to an opening and closing door is decreased by utilizing a linkage when the pressure releasing of the fixing unit is performed being interlocked with operation of the opening and closing door has been proposed in Japanese Patent Application Laid-open (JP-A) No. 2002-148992. Further, a link connection mechanism with which the fixing unit is easily detached and attached by simplifying engagement of a pressure release linkage of the fixing unit with the opening and closing door has been proposed in JP-A No. 2007-079488. In addition, an image forming apparatus which utilizes a linkage has been proposed in JP-A Nos. 2006-047647 and 2008-164781, and a process cartridge which utilizes a linkage has been proposed in JP-A No. 2007-047298.

However, with a pressure release mechanism which utilizes gears, the mechanism cannot be operated properly when a phase of the attached gears is shifted. In particular, since the fixing unit is a unit which may be replaced by a serviceman in the field, the gears need to be assembled at a predetermined phase when the fixing unit is attached or detached.

SUMMARY OF THE INVENTION

The present invention provides an image forming apparatus of a compact configuration in which occurrence of gear misassembling can be prevented during assembling and servicing.

The present invention also provides an image forming apparatus which includes a main assembly; an image forming unit for forming a toner image on a sheet; a fixing unit which fixes the toner image on the sheet by nipping and conveying the sheet at a fixing nip portion, the fixing unit including a pressure applying mechanism which applies pressure to the fixing nip portion and a cam member for releasing the pressure applied to the fixing nip portion by acting to the pressure applying mechanism and being detachably attachable to the main assembly; an opening and closing member which is attached to the main assembly to be capable of being opened and closed; a first gear which is provided at the main assembly and which is moved in accordance with movement of the opening and closing member; a second gear which is provided at the fixing unit for moving the cam member; and a connection gear which connects the first gear and the second gear by being engaged with both the first gear and the second gear and configured to be held by the fixing unit, wherein the connection gear is configured to be detachable from between the first gear and the second gear and to be attachable being engaged with both the first gear and the second gear only in a case that the first gear and the second gear are respectively at a predetermined phase and the apparatus includes an attaching prevention mechanism which prevents the fixing unit from being attached the main assembly in a state that the connection gear is held by the fixing unit.

Further features of the present invention will become apparent from the following description of exemplary embodiments (with reference to the attached drawings).

DESCRIPTION OF THE EMBODIMENTS

In the following, exemplary embodiments of the present invention are described in detail. Here, dimensions, materials, shapes, relative arrangements and the like of the components described in the following embodiments may be appropriately varied in accordance with a configuration and various conditions of an apparatus to which the present invention is applied. Further, unless particularly specified in a limited manner, the present invention is not limited to the following description.

First Embodiment

Image Forming Apparatus

Figure 1:
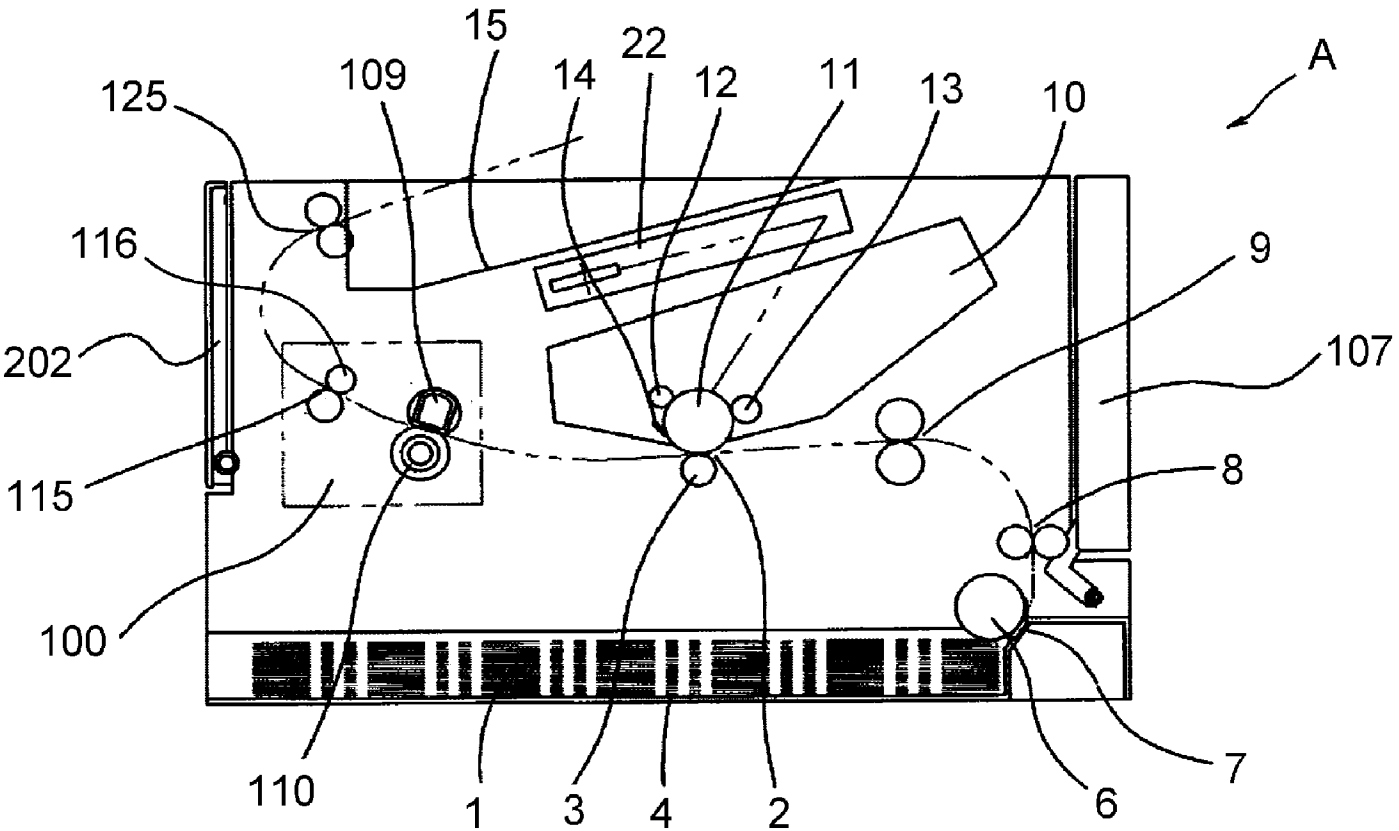
FIG. 1 is a schematic sectional view of an image forming apparatus of first and second embodiments.

An image forming apparatus A according to the present embodiment is described with an example of a laser-beam printer illustrated in FIG. 1. FIG. 1 is a schematic sectional view of the printer of the present embodiment. The whole configuration of the image forming apparatus according to the present invention is described along the flow of a sheet.

A plurality of sheets 1 piled on a sheet tray 4 are separated one by one and fed to an apparatus main assembly by a feed roller 6 and a separation pad 7.

The single sheet which is fed by the abovementioned operation is conveyed to a toner image transfer portion 2 where it is fed between a photosensitive drum 11 and a transfer roller 3 by a first conveying roller 8 and a second conveying roller 9 which respectively form a nip with an opposing roller.

On the other hand, the photosensitive drum 11 is turned clockwise and is evenly charged by a charger 12. Then, the photosensitive drum 11 is exposed with selective laser light which is irradiated by a laser scanner 22 based on an image signal so as to form an electrostatic latent image. The electrostatic latent image is visualized (i.e., to be a toner image) by a development device 13.

The toner image formed on the photosensitive drum 11 is electrically attracted by the transfer roller 3 so as to be sequentially transferred on an image forming surface (i.e., the upper surface) of the sheet which passes through the toner image transfer portion 2. In this manner, an image is formed. An image forming unit which forms the toner image on the sheet is configured with the photosensitive drum 11, the laser scanner 22, the development device 13 and the transfer roller 3.

The photosensitive drum 11, the charger 12, the development device 13 and a cleaning blade 14 are arranged in a process unit 10 which is held detachably attachable to the apparatus main assembly.

The sheet on which the image is formed is guided to a nip portion (i.e., a fixing nip portion) formed by a heating element 109 and a pressure roller 110 which is press-contacted thereto (i.e., a fixing unit) 100. By passing the sheet through the nip portion at which a nip is formed while nipping the sheet, the toner image transferred on the sheet surface is fixed on the sheet by being heated and pressed.

The sheet which passes through the fixing device 100 is conveyed by discharge rollers 115, 116, 125 and discharged onto a discharge tray 15. In this manner, the image forming operation is completed. Here, a sensor flag 117 is provided at the upstream of the sheet conveying direction of the discharge rollers 115, 116 as illustrated in FIG. 2.

(Fixing Device)

Figure 2:
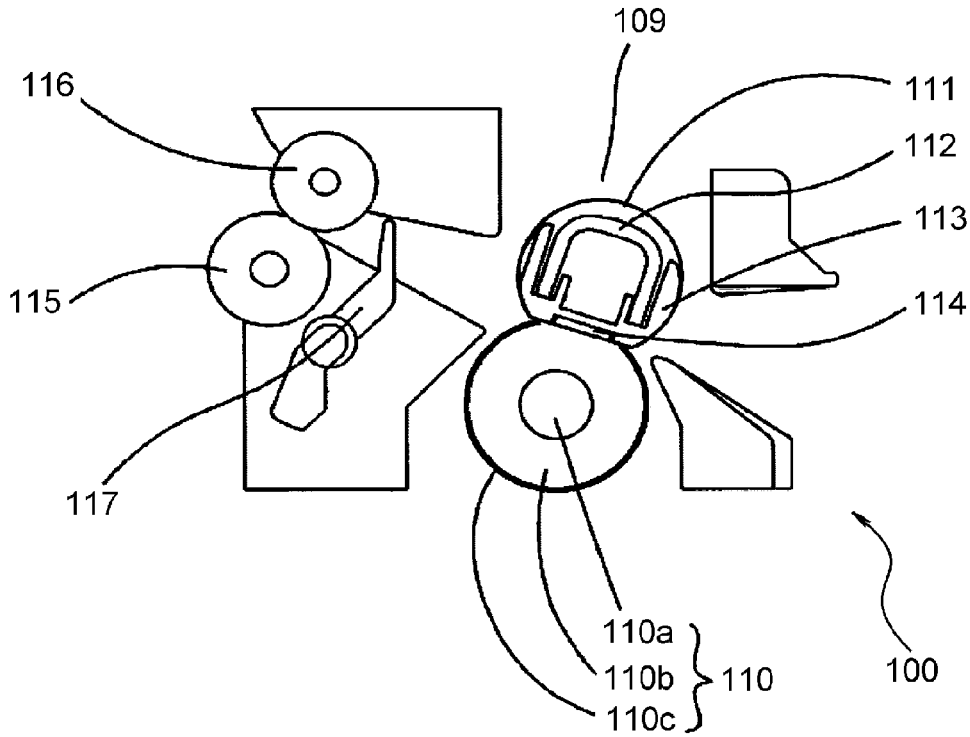
FIG. 2 is a schematic sectional view of the inside of a fixing unit according to the first embodiment.

FIG. 2 is a schematic sectional view of the fixing device (i.e., the fixing unit) 100. The configuration of the heating element and the pressure roller of the fixing device 100 are described based on FIG. 2. The fixing device 100 is detachably attachable to the image forming apparatus main assembly.

For example, the fixing device 100 of the present embodiment is a device of a so-called tensionless type which is disclosed in JP-A Nos. 4-44075 through 4-44083 and JP-A Nos. 4-204980 through 4-204984.

The heating element 109 is mainly configured with a fixing film 111, a heater 114, a heater holder 113 and a stay member 112 which are described later.

The fixing film 111 which is cylindrical is loosely fitted externally around the heater holder 113 which holds the heater 114 at the lower surface thereof. The fixing film 111 is formed of heat-resistant film of Polyimide (PI) of which surface is coated with fluororesin such as polytetrafluoroethylene (PTFE) having adequate toner parting properties.

The heat holder 113 is a tub-shaped member of which cross-section is approximately half-circular. The heat holder 113 is a heat-resistant member while also serving as a rotation guide member for the fixing film 111 which is external fitted thereto.

The heater 114 includes a ceramic substrate of a horizontally oriented thin-plate shape and a heat-resistant element which is formed on the surface of the substrate along the longitudinal direction thereof (i.e., the vertical direction to the drawing) as basic structural components. Heat is generated and temperature rises quickly by supplying power to the heat-resistant element so that the heater 114 is controlled to be a predetermined temperature by temperature control. The heater 114 is held by the heater holder 113 in a groove which is formed at the lower surface of the heater holder 113 along the longitudinal direction.

The section of the stay member 112 is an approximately inverted-U-shape and legs at lower parts contact to the inner surface of the heater holder 113. Both ends of the stay member 112 in the longitudinal direction receive pressing force of an urging member 118 such as a spring so that the stay member 112 presses the heater holder 113 and the heater 114 downward.

The pressure roller 110 is configured with a core 110*a*, a heat-resistant elastic solid 110*b* such as silicone rubber which is coaxially and integrally arranged to the core 110*a*, and a toner parting layer 110*c* of the surface which is formed of fluoro-coating or a tube.

The pressure roller 110 is driven to turn counterclockwise at a predetermined peripheral velocity by a drive portion of a gear and the like which are not illustrated in the drawings. Due to friction force between the pressure roller 110 and the outer surface of the fixing film 111 caused by the turn of the pressure roller 110, the fixing film 111 is driven to turn clockwise around the outer circumference of the heat holder 113. In order to decrease sliding resistance between the inner surface of the fixing film 111 and the lower surface of the heater 114 which is contacted thereto by sliding, a lubricant such as a heat-resistant grease is provided therebetween.

Figure 3:
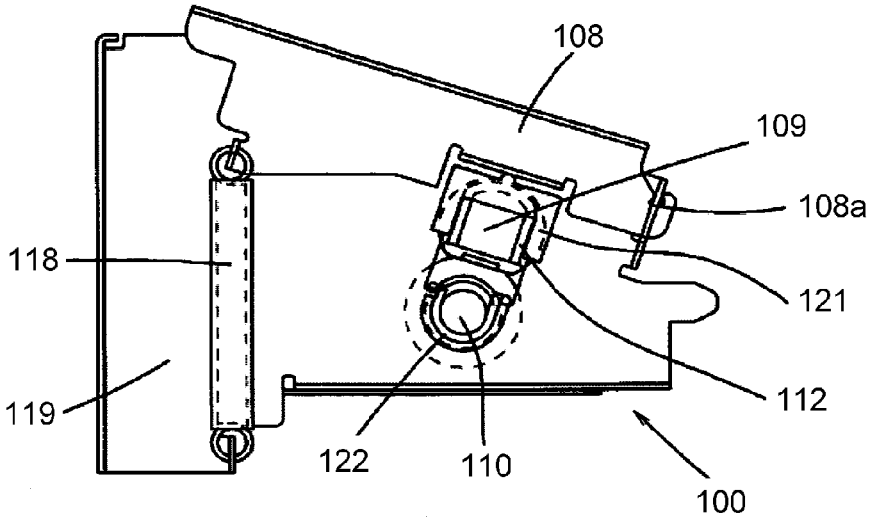
FIG. 3 is a side view of the fixing unit according to the first embodiment.

FIG. 3 is a side view of the entire fixing device (i.e., the fixing unit) 100.

The pressure roller 110 is rotatably supported by a fixing frame 119 via a bearing 122.

The heating element 109 is supported by the fixing frame 119 movably in the direction toward the pressure roller 110. Flange members 121 which restrict movement of the fixing film 111 in the longitudinal direction are provided respectively to both longitudinal ends of the heating element 109. The upper part of the flange member 121 is pressed by a pressure member (i.e., a pressure plate) 108. When the upper part of the flange member 121 is pressed by the pressure member 108, the pressing force is transmitted to the stay member 112, the heater holder 113 and the heater 114. Accordingly, the heater 114 is pressed to the pressure roller 110 via the fixing film 111.

Figure 7:
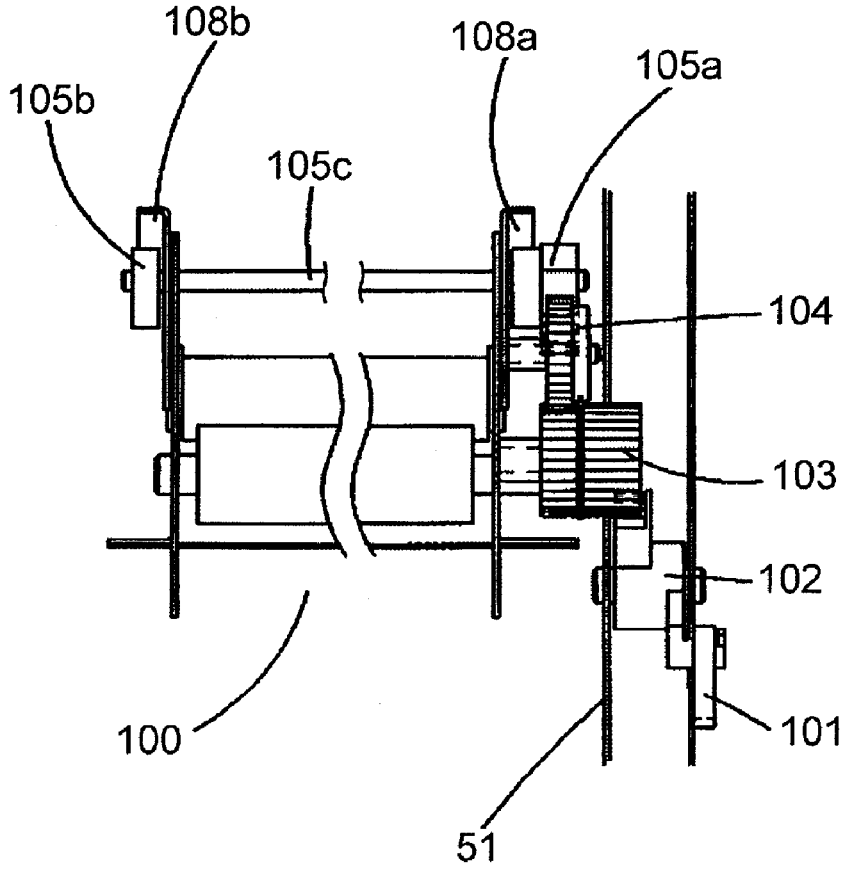
FIG. 7 is a detailed rear view of the pressure release mechanism according to the first embodiment.

The pressure member 108 is held by the fixing frame 119 turnably around hinge portions 108*a*, 108*b* (see FIG. 7). The pressure member 108 is urged downward in FIG. 3 by a tension spring 118 of which one end is supported by the fixing frame 119 so that the heating element 109 is urged toward the pressure roller 110.

The heat-resistant elastic solid 110*b* (illustrated in FIG. 2, but not in FIG. 3) of the pressure roller 110 is elastically deformed due to the pressing force so that the nip for fixing the toner image to the sheet is formed. In this manner, a pressure applying mechanism which applies pressure to the fixing nip portion is configured with the pressure member 108 and the tension spring 118.

(First Pressure Release Mechanism Moved with Operation of Opening and Closing Member Provided to Apparatus Front)

Figure 4:
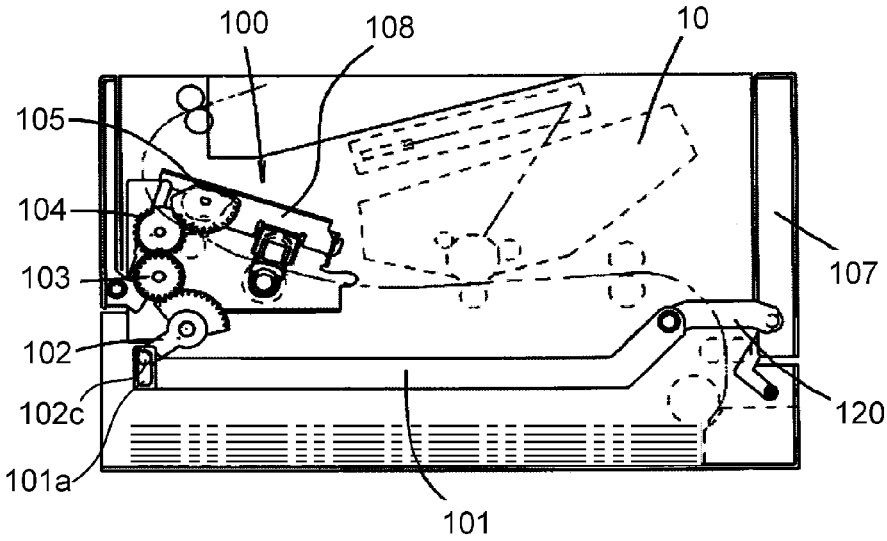
FIG. 4 is a side view which illustrates a pressure release mechanism of the image forming apparatus in a closed state according to the first embodiment.
Figure 5:
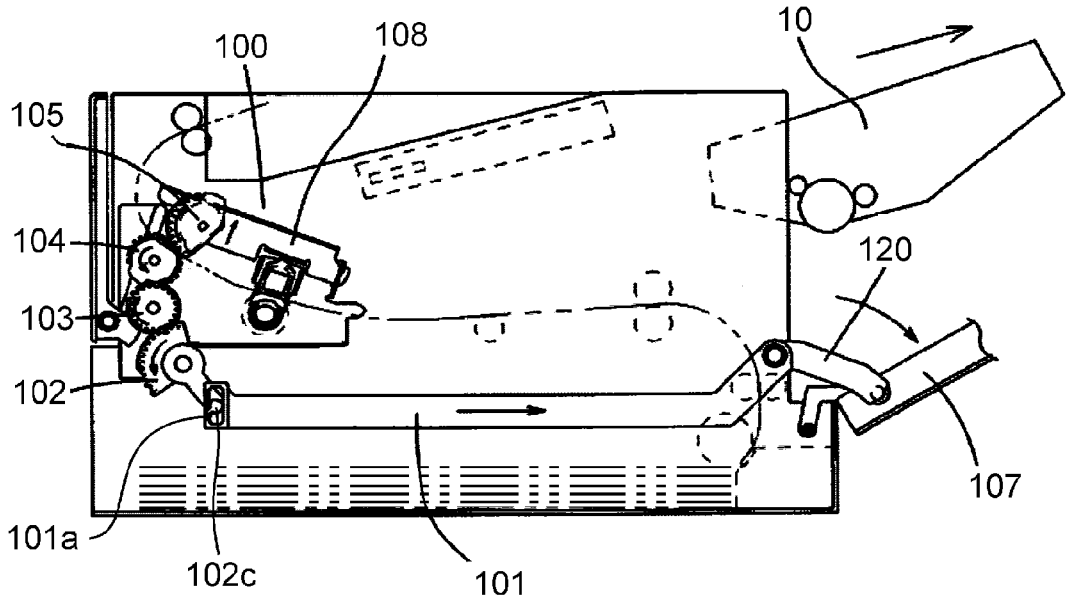
FIG. 5 is a side view which illustrates the pressure release mechanism of the image forming, apparatus in an opened state according to the first embodiment.
Figure 6:
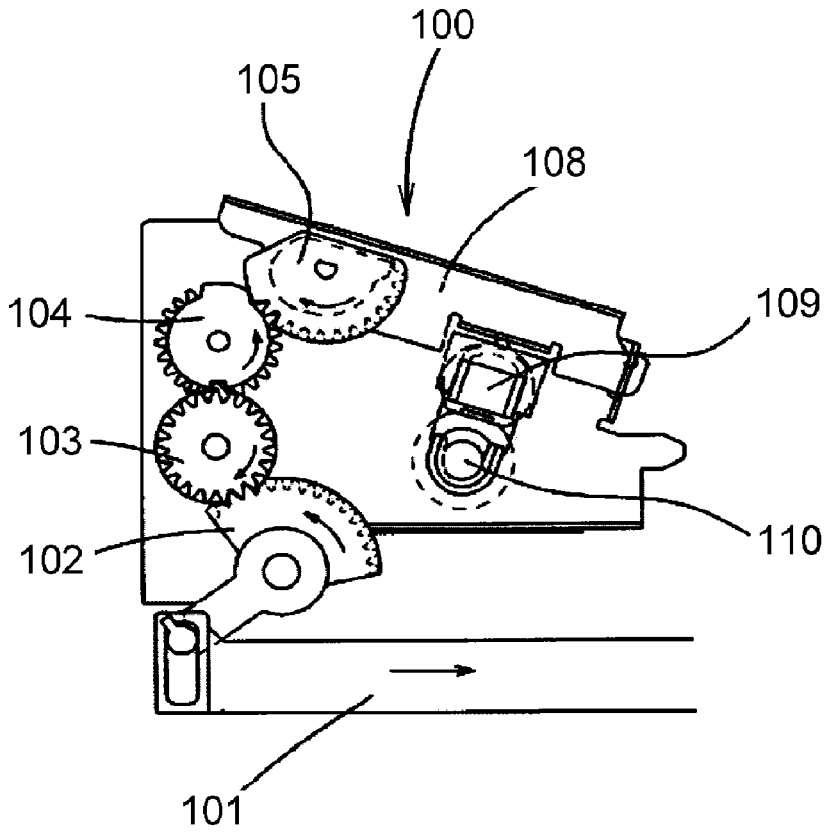
FIG. 6 is a detailed side view of the pressure release mechanism according to the first embodiment.

FIGS. 4 and 5 are side views which illustrate a pressure release mechanism of the image forming apparatus according to the present embodiment. FIG. 4 illustrates a state that a front opening and closing door 107 (an opening and closing member) is closed. FIG. 5 illustrates a state that the front opening and closing door 107 is opened (i.e., released). FIGS. 6 and 7 are detailed views of the pressure release mechanism. FIG. 6 illustrates a gear train viewing from the side thereof. FIG. 7 illustrates the gear train viewing from the rear thereof. The configuration and operation of the pressure release mechanism is described with reference to FIGS. 4 to 7.

As illustrated in FIGS. 4 and 5, the front opening and closing door 107 which is capable of being opened and closed at the front is turnably held by the image forming apparatus main assembly. By opening the opening and closing door 107, the inside of the apparatus main assembly is exposed so that attaching and detaching of the process unit 10 and jam recovery of a sheet which is jammed within the apparatus main assembly can be performed.

One end of a connection member 120 is engaged rotatably with the front opening and closing door 107 and the other end is engaged turnably with an arm member 101. Accordingly, operation of the front opening and closing door 107 is transmitted to the arm member 101.

As illustrated in FIGS. 4 to 6, the arm member 101 is movable only in the horizontal direction. Then, one end of the arm member 101 is engaged turnably with the connection member 120 and an elongated hole portion 101*a* is formed at the other end. The elongated hole portion 101*a* is engaged with a boss 102*c* which is provided at a main assembly side gear 102 (i.e., a first gear).

Here, although integral forming is possible, the connection member 120 and the arm member 101 are separately formed on purpose in order to reduce occupying area of the locus of the arm member 101. By forming the connection member 120 and the arm member 101 separately, the movement of the arm member 101 is restricted only in the horizontal direction.

The main assembly side gear 102 is turnably provided to the apparatus main assembly side. The main assembly side gear 102 includes a sector-shaped gear portion and the boss 102*c* which is engaged with the elongated hole portion 101*a* of the arm member 101.

A connection gear 103 is held by the fixing device 100 being detachably attachable and turnable. The connection gear 103 is engaged with the main assembly side gear 102 and a fixing unit side gear 104 (i.e., a second gear).

The fixing unit side gear 104 is turnably provided to the fixing device side and is engaged respectively with the connection gear 103 and a gear portion of a cam member 105. With a later-mentioned configuration, the nip of the heating element 109 and the pressure roller 110 is released due to the turn of the cam member 105. The cam member 105 releases the pressure at the fixing nip portion by acting against the pressure applying mechanism.

As illustrated in FIG. 7, the cam member 105 has cam portions 105*a*, 105*b* at both ends in the longitudinal direction of the fixing device 100 of which profiles are the same. The cam portions 105*a*, 105*b* are connected by a connection shaft 105*c* so as to be turned in phase. The cam portion 105*a* of one side has the gear portion to be engaged with the fixing unit side gear 104.

As illustrated in FIGS. 5 to 7, when the front opening and closing door 107 is opened, the arm member 101 is moved rightward in FIG. 5 via the connection member 120. The main assembly side gear 102 which is engaged with the elongated hole portion 101*a* of the arm member 101 is turned counterclockwise due to the movement of the arm member 101. Thus, the main assembly side gear (i.e., the first gear) 102 is moved in accordance with the movement of the front opening and closing door 107. The turn of the main assembly side gear 102 is transmitted to the connection gear 103 and the fixing unit side gear 104, and then, the cam member 105 is turned clockwise. The cam member 105 pushes the pressure member 108 upward and the urging force to the heating element 109 is released.

When performing the jam recovery from the front of the apparatus (i.e., from the right side in FIG. 5), it is needed to access to the sheet path by opening the front opening and closing door 107. Thus, the front opening and closing door 107 is opened at the time of jam recovery and the pressing force of the fixing device is released. Therefore, the jammed sheet can be easily removed even in a state that the sheet is pinched at the nip of the fixing device.

(Second Pressure Release Mechanism Moved with Operation of Opening and Closing Member Provided to Apparatus Rear)

Figure 8:
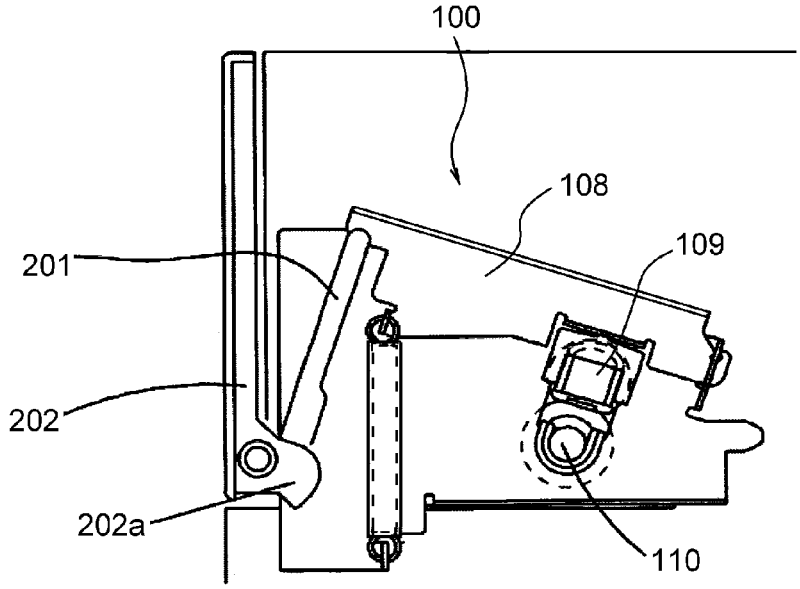
FIG. 8 is a side view which illustrates the pressure release mechanism when a rear opening and closing door is operated to be closed.
Figure 9:
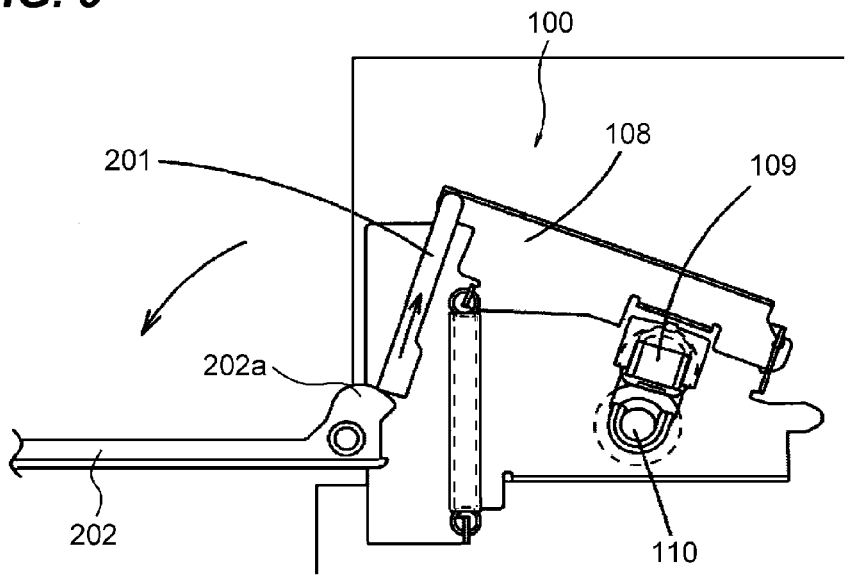
FIG. 9 is a side view which illustrates the pressure release mechanism when the rear opening and closing door is operated to be opened.

FIGS. 8 and 9 are side views which illustrate a state that pressure releasing is preformed from the rear side of the apparatus. FIG. 8 illustrates a state that a rear opening and closing door 202 is closed and FIG. 9 illustrates a state that the rear opening and closing door 202 is opened. The jam recovery which is preformed from the rear side of the apparatus (i.e., the left side in the drawings) is described with reference to FIGS. 8 and 9.

As illustrated in FIG. 8, the rear opening and closing door 202 (i.e., an opening and closing member) capable of being opened and closed at the rear is held turnably by the image forming apparatus main assembly. By opening the rear opening and closing door 202, jam recovery can be performed for the sheet which is jammed within the apparatus main assembly, in particular, for the sheet which is jammed at a position which is difficult to be accessed from the front side of the apparatus. The rear opening and closing door 202 has a cam portion 202*a* which is contacted to a later-mentioned arm member 201.

The arm member 201 is supported by the fixing unit to be movable approximately in the horizontal direction (i.e., the arrow direction in FIG. 9) and the bottom end thereof is contacted to the cam portion 202*a* of the rear opening and closing door 202.

In this state, when the rear opening and closing door 202 is opened as illustrated in FIG. 9, the larger diameter part of the cam portion 202*a* abuts the arm member 201. Consequently, the cam portion 202*a* pushes the bottom end of the arm member 201 upward in the drawings. Then, the upper end of the arm member 201 pushes the pressure member 108 upward and the urging force to the heating element 109 is released.

Here, the cam portion 202*a* is arranged respectively at both ends in the longitudinal direction of the rear opening and closing door 202 (i.e., the direction perpendicular to the sheet conveying direction). Further, the arm member 201 is arranged respectively at both ends in the longitudinal direction of the fixing device 100. Different from the above-mentioned first pressure release mechanism which is interlocked with the front opening and closing door 107, the second pressure release mechanism adopts a different mechanism because the rear opening and closing door 202 is located in the vicinity of the fixing device 100 and the space occupied thereby is not needed to be large. In this mechanism, the cam is arranged at the rear opening and closing door 202 so that the arm member 201 is operated only linearly. Accordingly, the occupying space is considerably decreased.

When performing the jam recovery from the rear of the apparatus, it is necessary to access to the sheet path by opening the rear opening and closing door 202. Thus, the rear opening and closing door 202 is opened at the time of jam recovery and the pressing force of the fixing device is released as described above. Therefore, the jammed sheet can be easily removed even in the state that the sheet is pinched at the nip of the fixing device.

The first pressure release mechanism which is interlocked with the front opening and closing door 107 and the second pressure release mechanism which is interlocked with the rear opening and closing door 202 independently act on the pressure member 108. Accordingly, in addition to a case that either the front opening and closing door 107 or the rear opening and closing door 202 is opened, the effect of pressure releasing can be obtained without operational interference even in a case that both of the doors are simultaneously opened.

(Phase Positioning Configuration of Connection Gear)

Figure 10A:
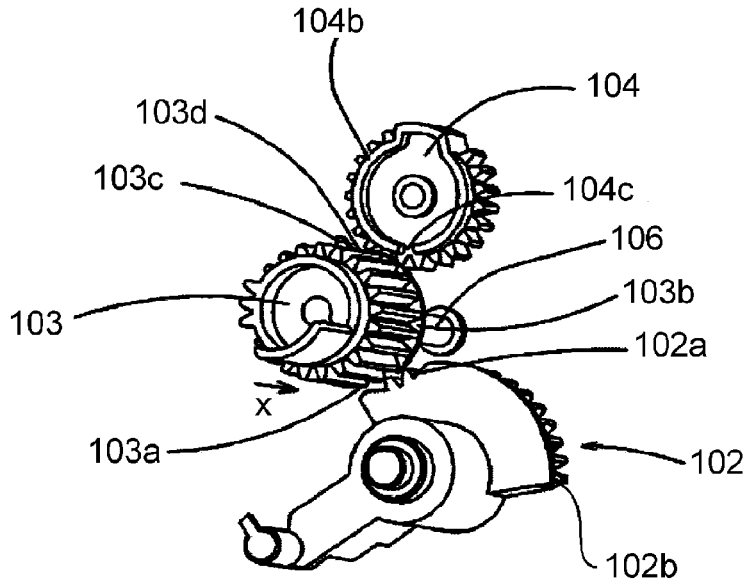
FIGS. 10A and 10B are perspective views which illustrate an attaching configuration of a connection gear according to the first embodiment in midstream of attaching.
Figure 10B:
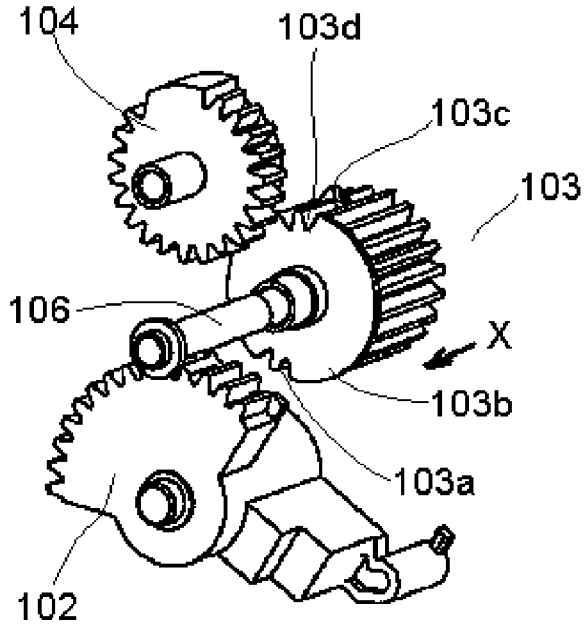
Figure 11A:
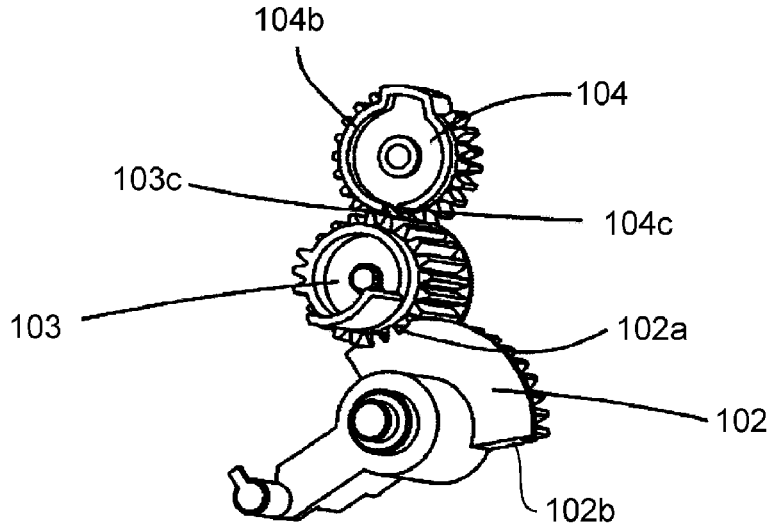
FIGS. 11A and 11B are perspective views which illustrate the attaching configuration of the connection gear according to the first embodiment after the attaching.
Figure 11B:
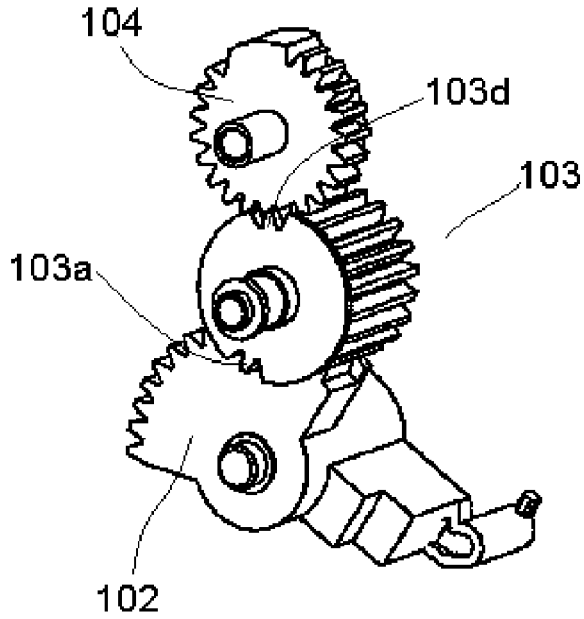

FIGS. 10A to 11B are perspective views which illustrate the attaching configuration of the connection gear 103. FIGS. 10A and 10B illustrate a state in the midstream of assembling. FIG. 10B illustrates the state viewing FIG. 10A from the back side. FIGS. 11A and 11B illustrate a state after attaching the connection gear 103. FIG. 11B illustrate the state viewing FIG. 11A from the back side. A method of phase positioning of the gears according to the present embodiment is described with reference to FIGS. 10 and 11. Here, arrow X illustrated in FIGS. 10A and 10B denotes the direction for attaching the connection gear 103 to the fixing unit.

In order to properly operate the abovementioned pressure release mechanism which is interlocked with the front opening and closing door 107, the phases of all the gears must be arranged in a unique manner. A variety of methods can be considered for the phase positioning. In the following, two methods are described.

One is a method to utilize a flange which is arranged at the gear. The main assembly side gear 102 has a flange portion 102*b* at the front side of the gear portion. Then, an arc-shaped cutout portion (i.e., a first gear side phase alignment portion) 102*a* is formed at the flange portion 102*b*.

On the contrary, the connection gear 103 has a flange portion 103*b* at the back side. Then, a cutout portion (a first phase alignment portion of the connection gear side) 103*a* is formed at a part of the flange portion 103*b*. The cutout portion 103*a* is cut out to be arc-shaped to follow the outer circumference of the connection gear 103. The connection gear 103 is detachably attachable to a spindle 106 in the direction of arrow X (i.e., the direction perpendicular to the direction of detaching and attaching of the fixing unit).

In a case that the connection gear 103 is to be attached to the spindle 106, the connection gear 103 cannot be assembled because of interference of the flange portions unless the cutout portion 102*a* of the flange 102*b* and the cutout portion 103*a* of the flange portion 103*b* are overlapped. Namely, only when the cutout portion 102*a* and the cutout portion 103*a* are located to be overlapped each other, the connection gear 103 and the main assembly side gear 102 are assembled together as illustrated in FIG. 11. Accordingly, the connection gear 103 and the main assembly side gear 102 are assembled surely at a predetermined phase.

The other is a method to align a projection portion and a cutout portion. The fixing unit side gear 104 has a rib 104*b* at a gear-side-surface thereof at the connection gear 103 side. Further, a cutout portion (i.e., a fixing unit side phase alignment portion) 104*c* is formed at a part of the rib 104*b*.

The connection gear 103 has a flange portion 103*b* at the back side and a projection portion 103*c* (i.e., a second phase alignment portion of the connection gear side). Then, an arc-shaped cutout portion 103*d* is formed at the flange portion 103*b*.

When the connection gear 103 is to be attached to the spindle 106, the connection gear 103 cannot be inserted due to interference of the flange portion 103*b* unless the connection gear 103 is inserted at the appropriate phase. Further, the insertion of the connection gear 103 cannot be completed because the projection portion 103*c* sits on the rib 104*b* unless the fixing unit side gear 104 is located at the appropriate phase. The connection gear 103 is prevented from disengaging from the spindle 106 with a fixing portion (i.e., a snap-fit, not illustrated). When the insertion of the connection gear 103 is not completed, the snap-fit is not locked so that the attaching is not completed. Accordingly, the fixing unit side gear 104 and the connection gear 103 are assembled surely at a predetermined phase. Namely, only when the phase of the cutout portion 104*c* arranged at a part of the rib 104*b* of the fixing unit side gear 104 is aligned with the phase of the projection portion 103*c* arranged at the connection gear 103, the connection gear 103 can be inserted until the appropriate position. As mentioned above, when the phases of the both are aligned, the projection portion 103*c* enters into the cutout portion 104*c*. Here, shapes of the projection portion 103*c* and the rib 104*b* need to be designed so as not to disturb the turn of the fixing unit side gear 104 and the connection gear 103 (i.e., so as not to occur contact between the projection portion 103*c* and the rib 104*b* during the turn of the fixing unit side gear 104 and the connection gear 103).

As described above, the connection gear 103 is detachable from between the main assembly side gear (i.e., the first gear) 102 and the fixing unit side gear (i.e., the second gear) 104. Then, the connection gear 103 is configured to be engaged with both the first gear 102 and the second gear 104 only in the case that the first gear 102 and the second gear 104 are located respectively at a predetermined phase.

Figure 12:
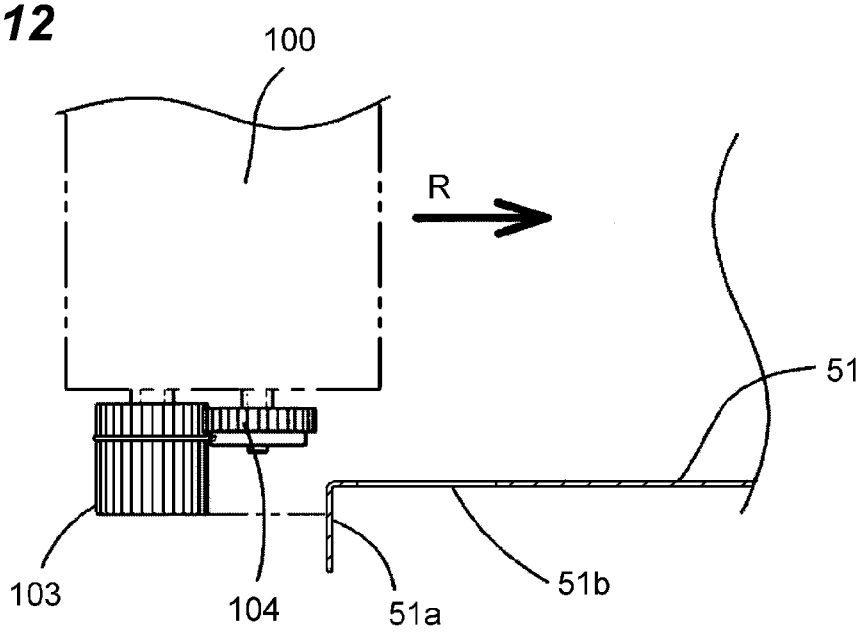
FIG. 12 is a view which illustrates a state that a connection gear is attached to the fixing unit before the fixing unit is attached to an image forming apparatus main assembly.
Figure 13:
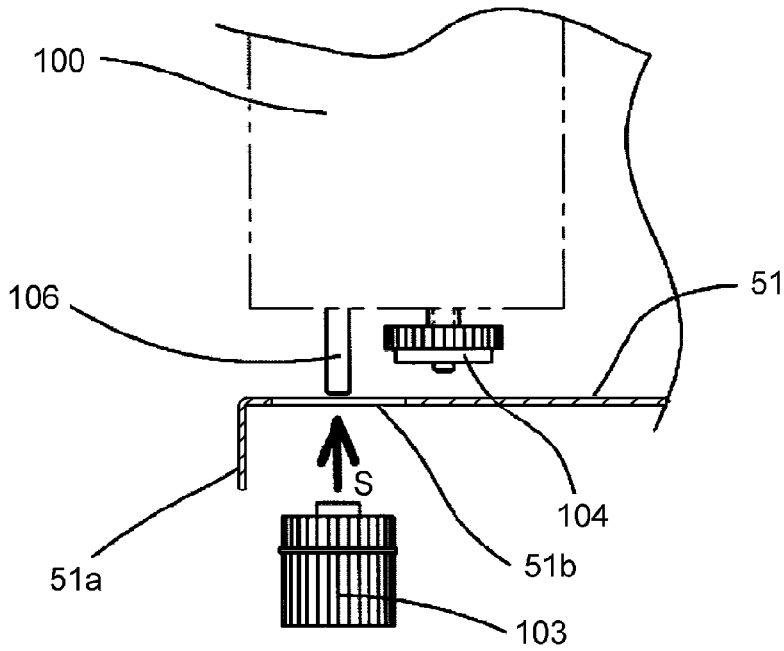
FIG. 13 is a view which illustrates a state that the connection gear is to be attached after the fixing unit is attached to the image forming apparatus main assembly.

FIGS. 12 and 13 are views which illustrate detaching and attaching of the fixing device 100 to the apparatus main assembly. FIG. 12 illustrates a state that the connection gear 103 is attached to the fixing device 100 before the fixing device 100 is attached to the image forming apparatus main assembly. FIG. 13 illustrates a state that the connection gear 103 is to be attached after the fixing device 100 is attached to the image forming apparatus main assembly. The configuration of attaching prevention of the fixing device 100 with the connection gear 103 is described with reference to FIGS. 12 and 13.

As described above, the connection gear 103 is configured to be detachably attachable to the fixing device 100 in the direction of arrow S in FIG. 13 (i.e., the same direction of arrow X in FIG. 10). A frame member 51 of the apparatus main assembly has a bend portion 51*a*. The fixing device 100 is configured to be detachably attachable to the apparatus main assembly in the direction of arrow R in FIG. 12. In the case that the fixing device 100 is to be attached to the image forming apparatus main assembly, first, a rear cover of the image forming apparatus main assembly which holds the rear opening and closing door 202 is removed. The fixing device 100 is attached to the image forming apparatus main assembly through an opening which appears by removing the rear cover.

As illustrated in FIG. 12, when the fixing device 100 is to be attached to the image forming apparatus main assembly in the direction of arrow R in the state that the connection gear 103 is previously attached to the fixing device 100, the fixing device 100 cannot be attached due to the interference of the locus of the connection gear 103 with the bend portion 51*a* of the frame member 51.

On the other hand, as illustrated in FIG. 13, the locus of the connection gear 103 does not interfere with the bend portion 51*a* when the connection gear 103 is detached from the fixing device 100. Therefore, the fixing device 100 can be attached to the image forming apparatus main assembly.

In this manner, the connection gear 103 is assembled to the fixing device 100 through an opening portion 51*b* of the frame member 51 after the fixing device 100 is attached to the image forming apparatus main assembly. Namely, the image forming apparatus of the present embodiment is configured that the process of attaching the connection gear 103 to the fixing device 100 is performed surely after the process of attaching the fixing device 100 to the apparatus main assembly. Thus, the connection gear 103 is configured to be held by the fixing unit. In this manner, the image forming apparatus has the attaching prevention mechanism (i.e., corresponding to the connection gear 103 and the bend portion 51*a* in the present embodiment) which prevents the fixing unit from being attached to the image forming apparatus main assembly in the state that the connection gear is previously held by the fixing unit.

Further, as described above, the connection gear 103 is assembled with the fixing unit side gear 104 and the main assembly side gear 102 surely at the predetermined phase. Therefore, when assembling an apparatus main assembly or when a fixing device is replaced in the market by a serviceman, the effect of fixing pressure release which is interlocked with a door can be surely obtained without causing phase shift of gears.

As described above, in the present embodiment, in the case of assembling the fixing unit to the image forming apparatus main assembly, the fixing unit is assembled to the image forming apparatus, and the connection gear capable of being assembled only at the predetermined phase with the apparatus main assembly side gear and the fixing unit side gear is attached thereafter. Thus, the assembling is performed surely in this order. Accordingly, the gears are assembled surely at the predetermined phase and the apparatus of high reliability can be provided.

Further, since the gear phase can be reliably determined, it is necessary to arrange the connection member 120 and the arm member 101 for connecting the opening and closing door 107 and the main assembly side gear 102 only at one side of the image forming apparatus main assembly. And, it is necessary to arrange only the cams at both sides in the longitudinal direction of the fixing device for performing pressure release at the nip portion of the fixing device. Accordingly, the space occupied by the mechanism is reduced so that the apparatus can be configured to be compact.

Second Embodiment

Figure 14:
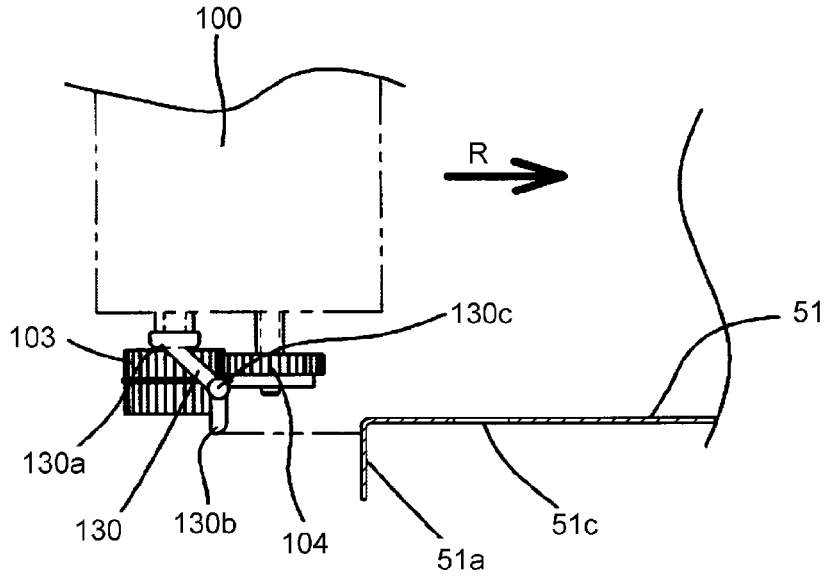
FIG. 14 is a view which illustrates a state that an attaching prevention member according to a second embodiment is located at an engagement position.
Figure 15:
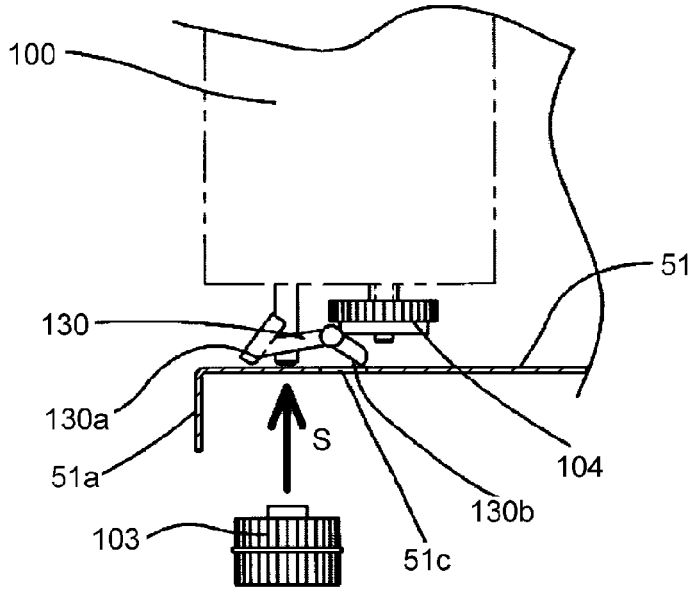
FIG. 15 is a view which illustrates a state that the attaching prevention member according to the second embodiment is located at a retraction position.

FIGS. 14 and 15 are views which illustrate detaching and attaching of the fixing device 100 to/form the image forming apparatus main assembly according to the second embodiment. The configuration of attaching prevention of the fixing device 100 with the connection gear 103 is described with reference to FIGS. 14 and 15.

Here, since the configuration of the image forming apparatus main assembly, the interlocking configuration between the opening and closing door and the pressure release of the fixing device, and the phase positioning method of the gears are the same as the first embodiment, the description thereof is not repeated.

The connection gear 103 is configured to be detachably attachable to the fixing device 100 in the direction of arrow S (i.e., the same direction of arrow X in FIG. 10). The fixing device 100 is configured to be detachably attachable to the image forming apparatus main assembly in the direction of arrow R. The frame member 51 of the image forming apparatus main assembly has the bend portion 51*a*.

An attaching prevention member 130 is supported by the fixing device 100 turnably around a turn center 130*c*. The attaching prevention member 130 includes an abutting portion 130*a* which abuts to the connection gear 103 and a stopper portion 130*b*. The attaching prevention member 130 is supported to be movable between an engagement position for preventing attaching of the fixing device 100 by being engaged with the image forming apparatus main assembly (i.e., the position of FIG. 14) and a retraction position for enabling attaching of the fixing device 100 by being retracted (i.e., the position of FIG. 15). With this configuration, the attaching prevention member 130 is at the engagement position when the connection gear 103 is attached. On the other hand, the attaching prevention member 130 is at the retraction position when the connection gear 103 is removed.

As illustrated in FIG. 14, when the connection gear 103 is attached to the fixing device 100, the abutting portion 130*a* of the attaching prevention member 130 is turned by being pushed by the connection gear 103 and the stopper portion 130*b* is projected outward. When the fixing device 100 is attached to the image forming apparatus main assembly toward the direction of arrow R in this state, the fixing device 100 cannot be attached because of interference between the locus of the stopper portion 130*b* and the bend portion 51*a* of the frame member 51.

On the other hand, as illustrated in FIG. 15, in the state that the connection gear 103 is removed from the fixing device 100, the attaching prevention member 130 is turned counterclockwise by being urged by a spring (not illustrated) and the stopper portion 130*b* is retracted to the fixing device side. In this state, there is no interference between the locus of the stopper portion 130*b* and the bend portion 51*a*. Therefore, the fixing device 100 can be attached to the image forming apparatus main assembly. The connection gear 103 can be assembled to the fixing device 100 through an opening portion (not illustrated) of the frame member 51 after the fixing device 100 is attached to the image forming apparatus main assembly. Here, in order to prevent interference between the stopper portion 130*b* and the frame member 51 when the connection gear 103 is attached to the fixing device 100 after the fixing device 100 is attached to the image forming apparatus main assembly, an opening portion 51*c* through which the stopper portion 130*b* is projected is formed at the frame member 51.

With this configuration, the connection gear 103 is to be attached surely after the fixing device 100 is attached to the image forming apparatus main assembly. Further, as described above, the connection gear 103 is assembled to the fixing unit side gear 104 and the main assembly side gear 102 surely at the predetermined phase. Therefore, when assembling an apparatus main assembly or when a fixing device is replaced in the market by a serviceman, the effect of fixing pressure release which is interlocked with a door can be surely obtained without causing phase shift of gears.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a main assembly;

an image forming unit which forms a toner image on a sheet;

a fixing unit which fixes the toner image on the sheet by nipping and conveying the sheet at a fixing nip portion, said fixing unit including a pressure applying mechanism which applies pressure to the fixing nip portion and a cam member for releasing the pressure applied to the fixing nip portion by acting to said pressure applying mechanism and being detachably attachable to said main assembly;

an opening and closing member which is attached to said main assembly to be capable of being opened and closed;

a first gear which is provided at said main assembly and which is moved in accordance with movement of said opening and closing member;

a second gear which is provided at said fixing unit for moving said cam member; and a connection gear which connects said first gear and said second gear by being engaged with both said first gear and said second gear, said connection gear configured to be held by said fixing unit;

wherein said connection gear is configured to be detachable from between said first gear and said second gear and to be attachable being engaged with both said first gear and said second gear only in a case that said first gear and said second gear are respectively at a predetermined phase, and wherein said apparatus includes an attaching prevention mechanism which prevents said fixing unit from being attached to said main assembly in a state that said connection gear is held by said fixing unit.

2. The image forming apparatus according to claim 1, wherein said first gear, said connection gear and said second gear are each provided with a phase aligning portion for aligning a phase therebetween.

* * * * *